US006111208A

United States Patent [19]

Rochon et al.

[11] Patent Number: 6,111,208

[45] Date of Patent: Aug. 29, 2000

[54] MODULAR ELECTRICAL SWITCH

[75] Inventors: Sylvain Rochon; Gerard Bourriaux; Laurent Bouvier, all of Dole; Eric Pinero, Seyssinet; Claude Grelier, Grenoble, all of France

[73] Assignee: ITT Manufacturing Enterprises, Inc., Wilmington, Del.

[21] Appl. No.: 09/160,917

[22] Filed: Sep. 25, 1998

Related U.S. Application Data

[63] Continuation-in-part of application No. PCT/FR98/00181, Jan. 30, 1998.

[30] Foreign Application Priority Data

Jan. 31, 1997 [FR] France ..... 97 01039

[51] Int. Cl.[7] ..... H01H 19/36

[52] U.S. Cl. ..... 200/14

[58] Field of Search ..... 200/11 R–11 K, 200/18, 564, 570–572, 336

[56] References Cited

U.S. PATENT DOCUMENTS

| | | | |
|---|---|---|---|
| 3,778,566 | 12/1973 | Gusaras | 200/14 |
| 3,983,354 | 9/1976 | Gammie et al. | 200/155 R |
| 4,212,000 | 7/1980 | Yamada | 340/347 P |
| 4,275,279 | 6/1981 | Wagatsuma et al. | 200/11 DA |
| 4,346,269 | 8/1982 | Slavin et al. | 200/11 DA |
| 4,424,424 | 1/1984 | Hollenbeck, Jr. | 200/44 |
| 4,481,386 | 11/1984 | Rose | 200/11 R |
| 4,758,693 | 7/1988 | Hoffman | 200/11 R |

*Primary Examiner*—Michael Friedhofer
*Attorney, Agent, or Firm*—Thomas L. Peterson

[57] ABSTRACT

A rotary switch includes a housing (14) with a pair of fixed select terminals (44*a*, 44*b*) and a fixed common terminal (44*c*). A rotor (28) that can pivot about an axis (A1), carries a connector (48) with a contact pad (60) for engaging one of the select contacts at a time and a common contact (58) for engaging the common terminal on the housing. The common terminal on the housing is in the form of a track extending in an arc centered on the rotor axis to enable the common contact to remain in continuous engagement with the common terminal as the rotor turns. The common contact on the rotor forms a pair of tabs (62) that slideably engage opposite sides of the track. The connector on the rotor can shift radially to the axis, and is biased by a spring (64) to urge the contact pad toward a select terminal. A cam arrangement shifts the contact pad radially away from a select terminal as the rotor begins to turn from a center position, to minimize the duration of electric arcs. The housing has an inner face (68) extending in an arc between the pair of select terminals, with the inner face having a plurality of axially-extending grooves (69), to minimize the duration of electric arcs. A plurality of switches can lie in a stack, with each rotor having one end forming a drive protuberance (76) of non-circular cross section, and an opposite end forming a recess (78) for receiving the protuberance of an adjacent switch of the stack.

10 Claims, 5 Drawing Sheets

FIG.5
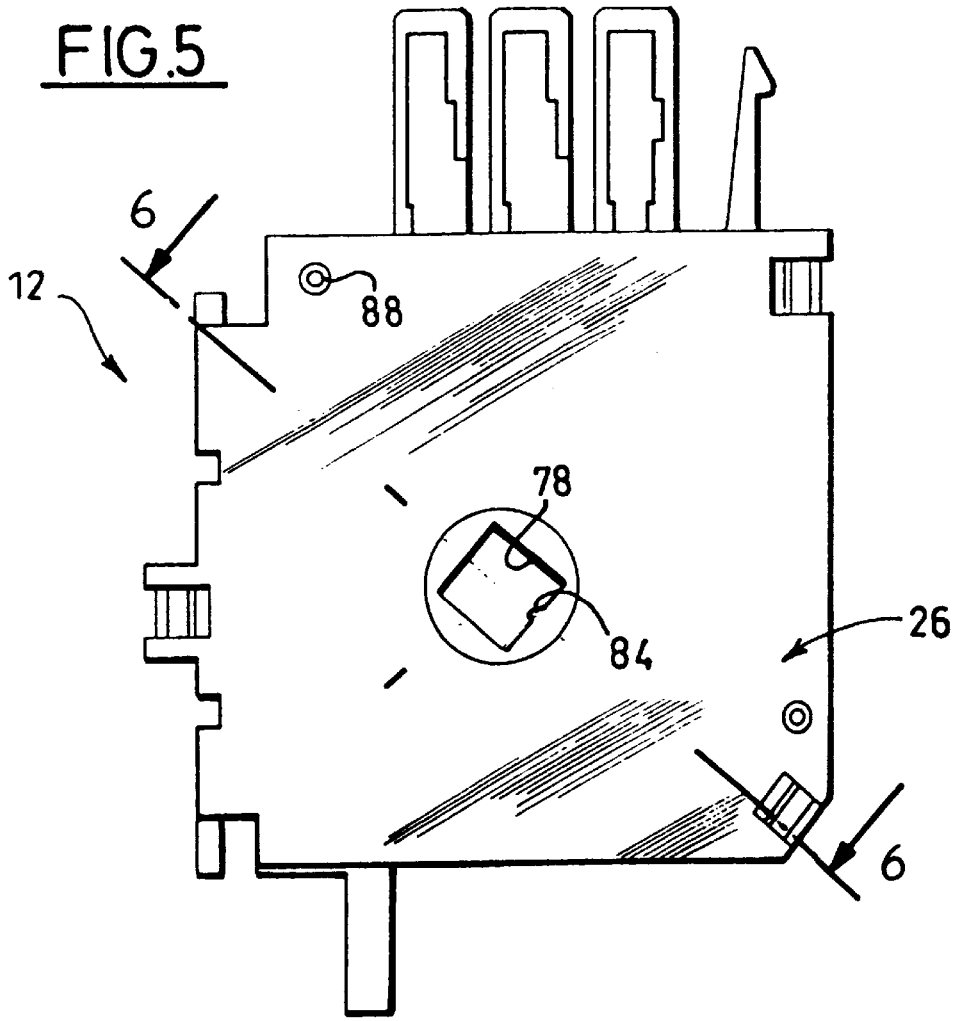
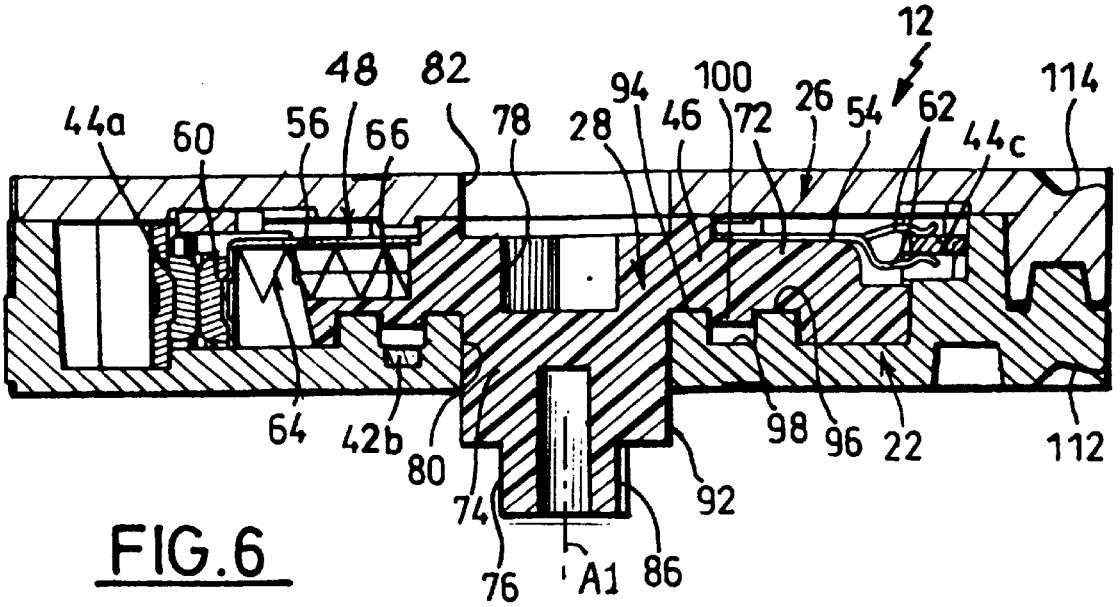
FIG.6

MODULAR ELECTRICAL SWITCH

CROSS REFERENCE

This is a continuation-in-part of PCT/FR98/00181 filed Jan. 30, 1998, which claims priority from French patent application 97/01039 filed Jan. 31, 1997.

BACKGROUND OF THE INVENTION

A rotary switch may include a rotor that pivots between first and second positions to connect a contact pad on the rotor to first or second select terminals on the switch housing. Such a switch can be used for transmitting power currents that energize appliances, or signal currents for controlling circuits. A stack of such switches can be used to operate many appliances, such as to energize a series of motors or operate a series of circuit breakers.

It is desirable that the torque for operating a switch be low so a moderate torque can operate all of the switches of a stack. It is desirable that the switches be constructed to minimize the duration of electric arcs occurring during switching, since a reduction in the time of each arc increases the life of the switch. A switch of minimum arc durations and low torque, which could be readily assembled in a stack, would be of value.

SUMMARY OF THE INVENTION

In accordance with one embodiment of the present invention, a switch and switch stack are provided, of rugged and simple design, which minimize sparking. The switch includes a rotor body that is pivotally mounted on a housing, a pair of select terminals mounted on the housing, and a common terminal mounted on the housing. A connector that is mounted on the rotor body, has a contact pad for engaging one or the other of the select terminals, and has a common contact that engages the common terminal at both positions of the rotor. The common terminal on the housing is in the form of a track that extends in an arc centered on the axis, and the common contact is continually engaged with the track as the rotor pivots between its first and second positions.

The common contact on the rotor includes a wiper with opposite tabs that bear against opposite faces of the track to assure low resistance engagement of the common contact with the common terminal as the rotor turns. The connector can shift in a radial direction on the rotor body, although it is biased toward a position where the contact pad engages a select terminal. A cam arrangement can be used to shift the contact pad radially away from a select terminal when the rotor turns by a small angle from the center of the first or second rotor position. This more rapidly disengages the contact pad from a select terminal and thereby reduce the duration of sparks. A housing has an annular inner face extending between the two select terminals, with that face having axially-extending scores to further minimize sparking.

The rotor includes a shank with one end forming a drive protuberance of non-circular cross section, and with the opposite end of the shank having a recess of a cross-section complimentary to the first end. This allows a group of switches to be stacked, with a protuberance of each rotor received in the recess of an adjacent rotor so all shanks and their corresponding rotors turn together.

The novel features of the invention are set forth with particularity in the appended claims. The invention will be best understood from the following description when read in conjunction with the accompanying drawings.

BRIEF DESCRIPTION OF THE DRAWINGS

FIG. 5 is a front elevation view of the switch of FIG. 2.

FIG. 6 is a sectional view taken on line 6—6 of FIG. 5.

DESCRIPTION OF THE PREFERRED EMBODIMENTS

Figure 1:
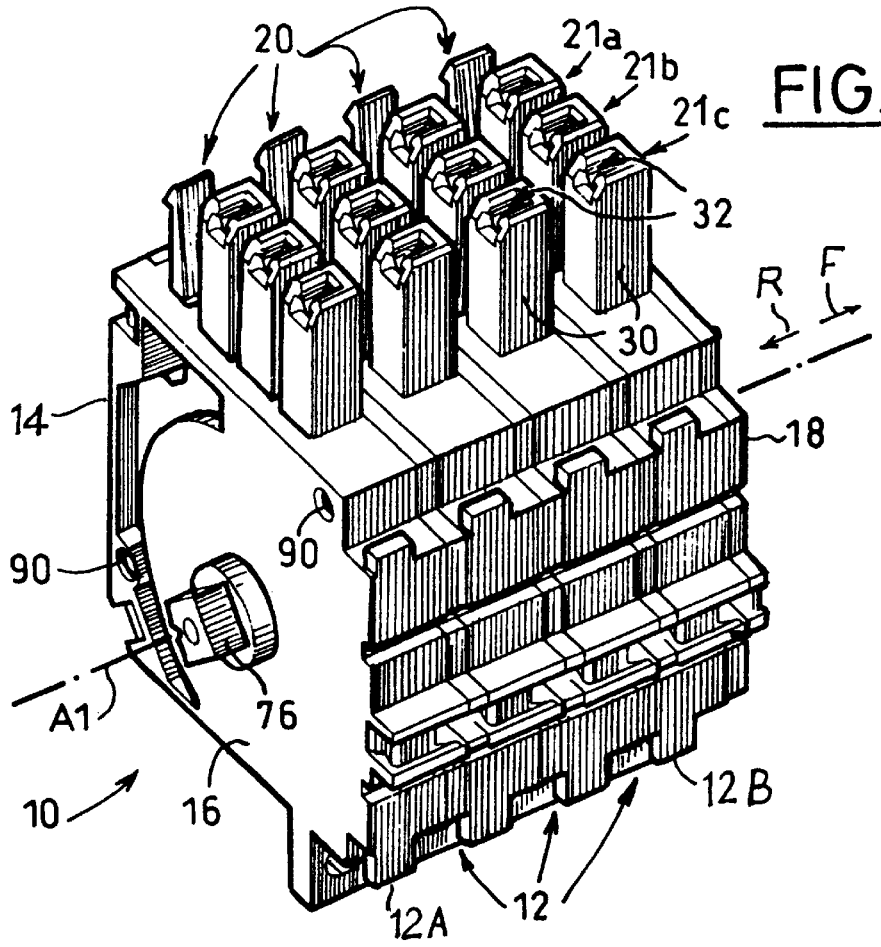
FIG. 1 is a rear isometric view of a stack of electrical switches of the invention, the stack including four substantially identical switches that are each constructed in accordance with the invention.
Figure 2:
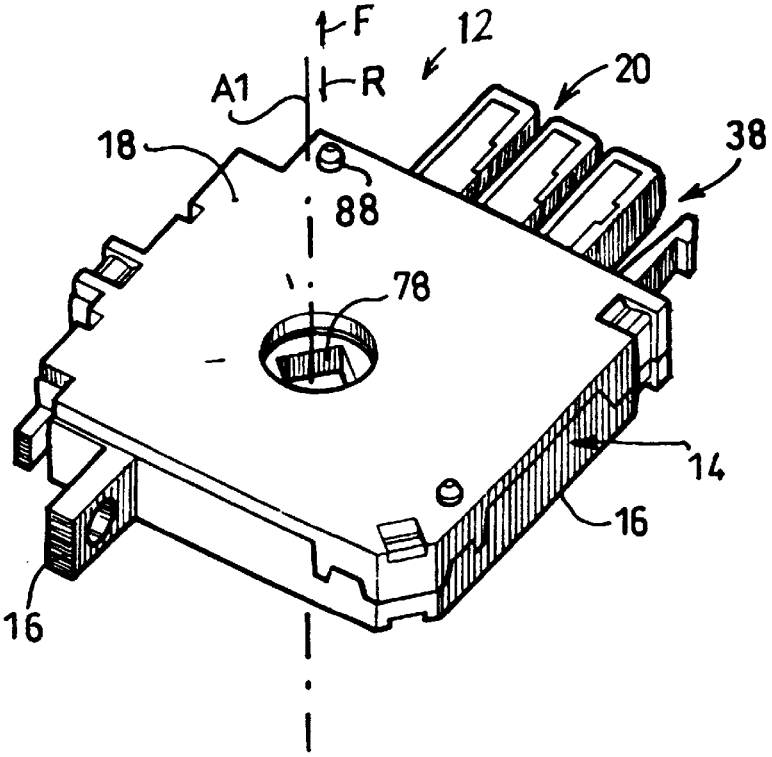
FIG. 2 is a front isometric view of a switch of FIG. 1.

FIG. 1 illustrates a stack 10 of switches 12 including a rearmost switch 12A and additional switches or switch devices 12B. Each switch includes a housing 14 with front and rear faces 18, 16 each lying in a transverse plane which is normal to an axis A1 of the switch. Each switch includes a connector portion 20 having three pins (21*a*, 21*b*, 21*c*) for connecting to an electrical appliance. The connector portions are preferably of a standardized type such as type "HE14" in accordance with standard UTE-C93-401.

Figure 3:
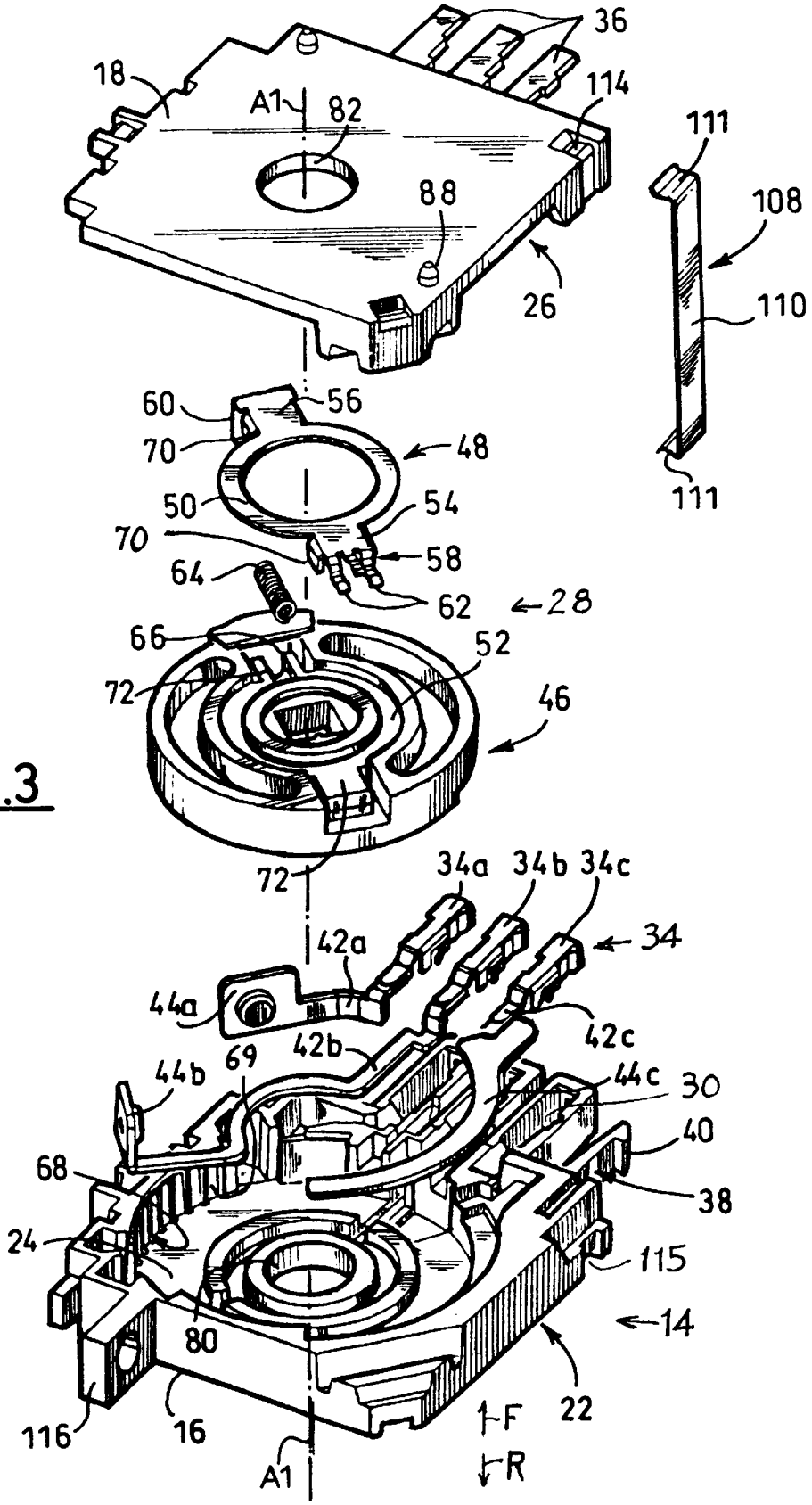
FIG. 3 is an exploded front isometric view of the switch of FIG. 2.
Figure 4:
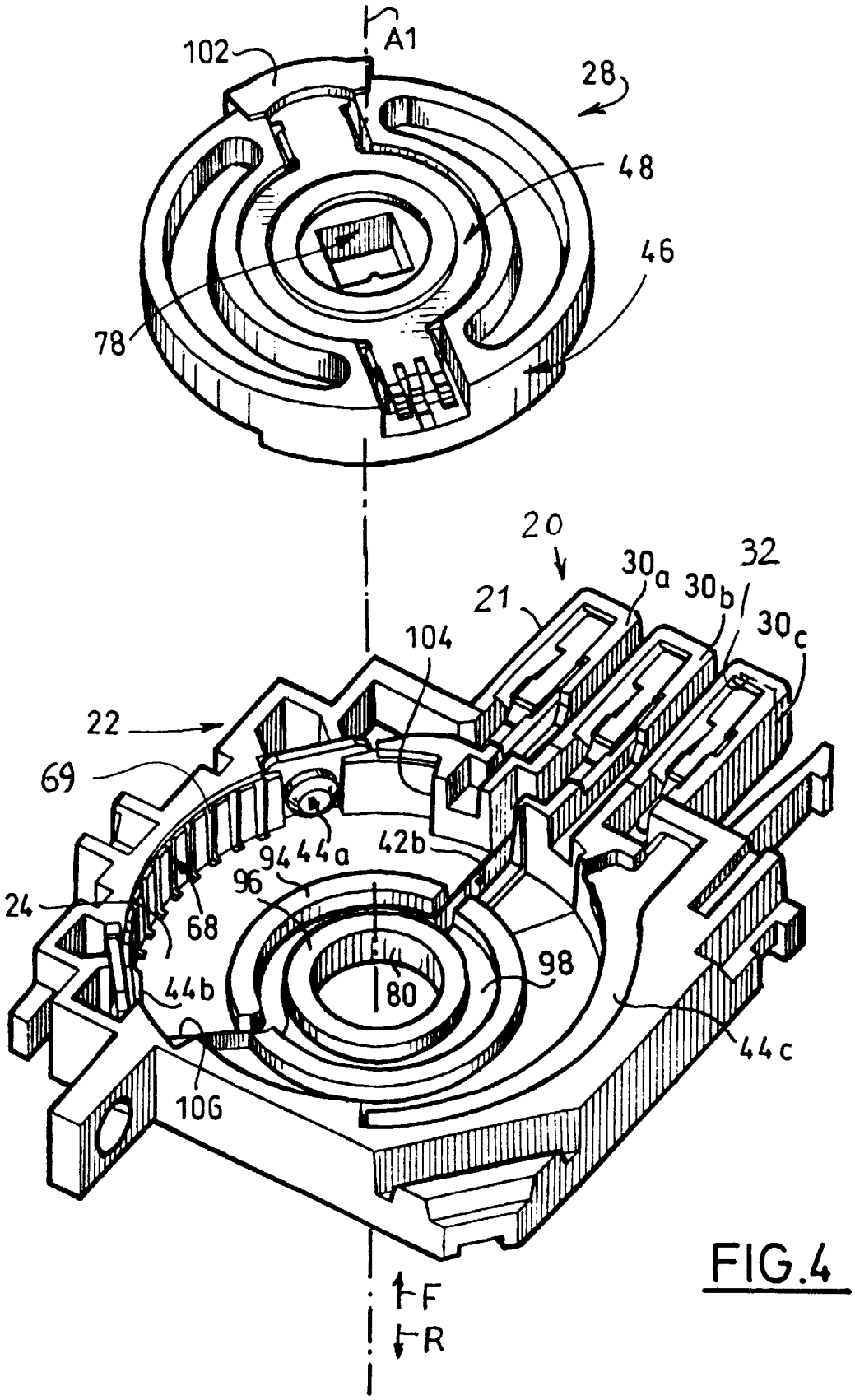
FIG. 4 is an exploded front isometric view of the switch of FIG. 3, showing the main housing part and rotor, with corresponding terminals and contacts mounted thereon.

As shown in FIG. 3, the housing 14 includes a main body 22 and a cover 26. The main body has a bottom wall 24 lying in a transverse plane. A rotor 28 is received between the main body and the cover, and can rotate about the axis A1. FIG. 4 shows that the connection portion 20 includes three projections 30*a*, 30*b*, 30*c* that are integral with the rest of the main body 22 of the housing. Each projection includes an opening 32 for receiving a pin of a mating connector (not shown) which connects to an appliance.

When the cover is removed, the forward ends of the projections 30 are open to receive terminals for engaging pins inserted through the openings 32. FIG. 3 shows three sockets 34*a*, 34*b*, 34*c* which can be inserted into the hollow projections 30. The cover 26 has tongues 36 that close the front ends of the projections.

The sockets 34 are connected through connecting strips 42*a*, 42*b*, 42*c*, to fixed terminals 44*a*, 44*b*, 44*c*. Two of the terminals 44*a*, 44*b* are referred to as select terminals, because only one at a time can be selected to carry current. The two select terminals 44*a*, 44*b* are each in the form of a button, and they are angled about 80° from one another about the axis A1. Both select terminals lie in a common transverse plane that is normal to the axis. The terminal 44*c* forms a track that extends along an arc that is centered on the axis A1 and that extends by an angle that at least equal to the angle between the select contacts 44*a*, 44*b*.

The rotor 28 includes a rotor body 46 of insulative material, which can pivot about the axis A1. A connector 48 of electrically conductive material such as a copper alloy sheet metal, is carried by the rotor. The connector includes a central part 50 which is received in a groove 52 of complimentary shape in a forward face of the rotor body. The connector has a pair of arms 54, 56 that extend radially outward from opposite sides of the central part 50. One arm forms a common contact that includes a wiper 58 for engaging the track 44*c*, while the other arm 56 forms a contact pad 60 for engaging a selected one of the two select terminals 44*a*, 44*b*. The wiper 58 includes three resilient tabs 62, two of which are designed to lie below or rearward of the tract 44*c*, and one of which is designed to lie above or against the forward face of the track. FIG. 6 shows the tabs 62 engaging opposite faces of the track 44*c*. Such engagement assures continuous low-friction engagement between the connector arm 54 and the track 44*c* despite a shift in the radial position of the connector arm 54 relative to the track. The free ends of the tabs 62 are constructed to ensure low resistance electrical contact with the track. The contact pad 60 lies at the periphery of the rotor body 46. In order to ensure firm engagement of the contact pad 60 with the select terminals, the connector 48 is mounted so it can slide axially on the rotor body 46. For this purpose, the central part 50 (FIG. 3) of the connector is received with radial play in the groove 52 of the rotor body. Also, a compression spring 64 is provided, which biases the contact pad 60 in a radially outward direction, while allowing the contact pad to move radially inward. Despite such radial movement of the connector 48, the tabs 62 of the common contact or wiper maintain low resistance engagement with the track 44*c*. The limit of radial movement of the connector is determined by the length of the tabs 62 and the radial width of the track 44*c*.

The connector 48 has a pair of turned-down guide flanges 70 at opposite sides of each arm 54, 56. Each pair of turn-down flanges extend rearwardly from the rest of the arm and straddle a block 72 on the rotor body 46. The blocks allow shifting of the connector 48 in opposite radial directions, while preventing the connector from shifting in perpendicular directions, to stabilize the position of the connector while allowing it to shift slightly.

FIG. 3 shows an inner cylindrical face 68 of the recess in the main body 22, being provided with axially-extending grooves or scores 69. The scores reduce the duration of electric arcs between the contact pad 60 and the select terminals 44*a*, 44*b* that sometimes occur as the contact pad is moving from one select terminal to the other.

Figure 7:
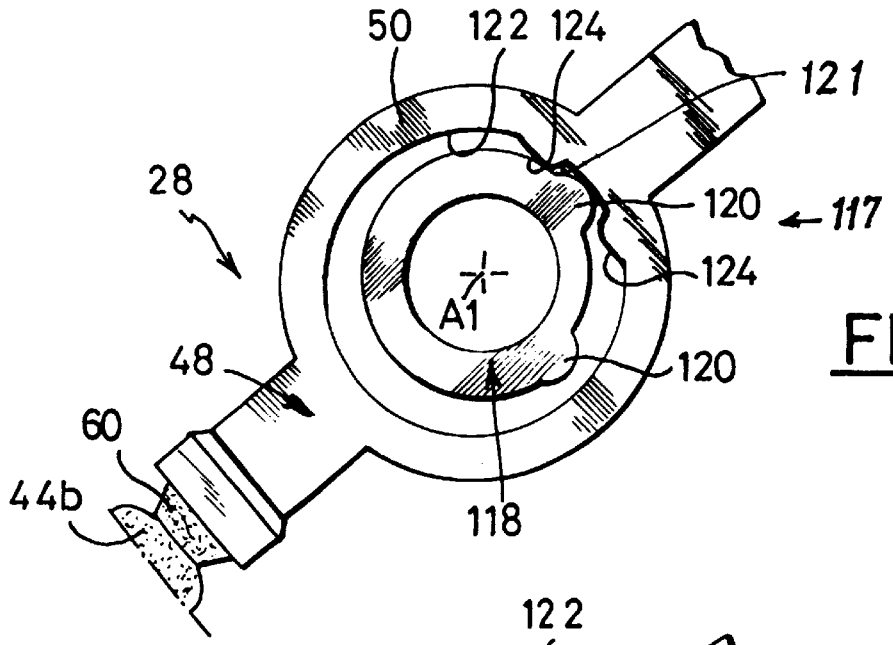
FIG. 7 is a front view of a portion of a switch constructed in accordance with another embodiment of the invention, where the contact pad is at a center of engagement with respect to a select terminal.
Figure 8:
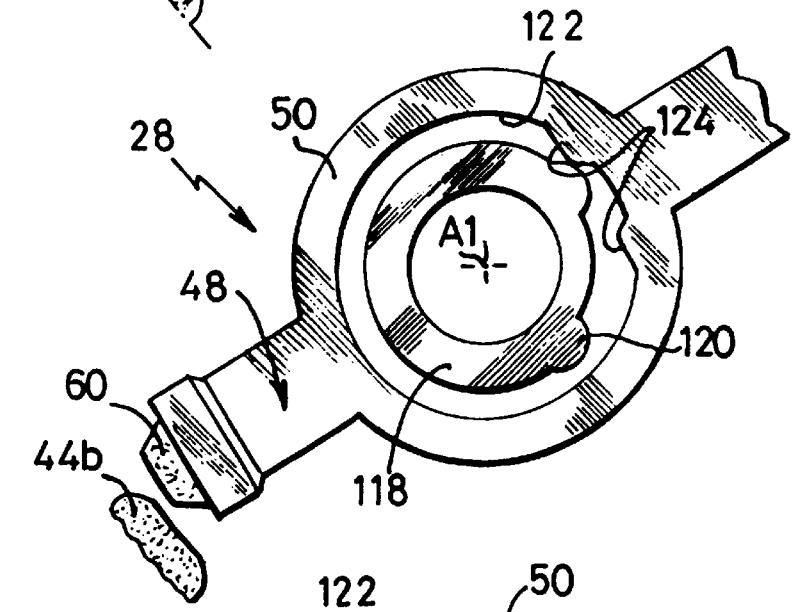
FIG. 8 is a view similar to that of FIG. 7, but with the contact pad slightly angled from the position of FIG. 7.
Figure 9:
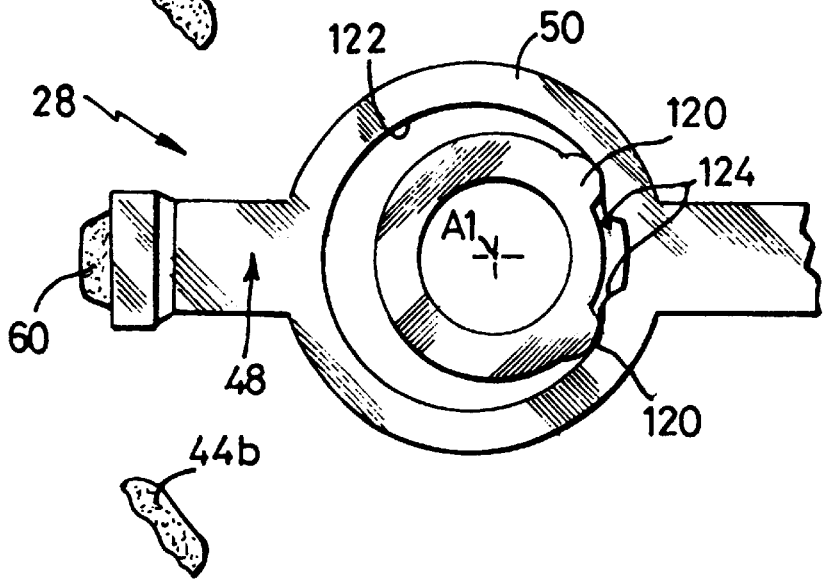
FIG. 9 is a view similar to that of FIG. 8, but with the contact pad halfway between center positions of engagement with the select terminals.

FIGS. 7–9 illustrate another embodiment of the invention which further reduces the period of sparks between the contact pad 60 and a select terminal such 44*b*. A mechanism 117 moves the contact pad 60 radially away from the select terminal 44*b* when the rotor turns slightly away from the central position of FIG. 7. In FIG. 7, a collar 118 that is fixed to the housing, such as to the cover, lies within the circular or annular part 50 of the connector 48. One of two bosses 120 lies in a recess 121 of the connector 48, to allow the contact pad 60 to firmly engage the terminal 44*b*. FIG. 8 shows the connector 50 after it and the rotor body have rotated by several degrees from this center contact position of FIG. 7. Such rotation of the connector 48 results in a boss 120 riding along a ramp 124 that moves the connector in a radial direction to move the contact pad 60 away from the select terminal 44*b*. Such radial movement of the connector occurs after a rotor rotation that is less than half the angle over which the pad 60 and select terminal 44*b* engage. Such radial movement of the connector 48 results in the sudden opening of a gap between the contact pad and select terminal, to minimize the period during which a spark extends between them and therefore to increase the life of the contact pad and select terminal. However, in the center position of FIG. 7, contact is made over a large area of engagement. The spring that urges the contact 48 in a direction to push the contact pad 60 against the select terminal 44*b*, assures firm engagement in the center position of FIG. 7. FIG. 9 shows the connector 48 after it has rotated about 40° from the position of FIG. 7.

FIG. 6 shows that the rotor body includes a central shank 74 with axially opposite ends. One end forms a protuberance 76 of noncircular shape, the particular shape being square. The opposite end forms a recess 78 of a shape complimentary to the protuberance 76. This allows a plurality of switches similar to that of FIG. 6, to be stacked, with a protuberance 76 of the switch received in the recess 78 of the adjacent switch. As shown in FIG. 5, the recess includes a key 84, while FIG. 5 shows that the projection includes a complimentary groove 86 for receiving the key. The key and groove 86 can both be considered to be keys. This assures that when the switches are stacked, that they are all in the same relative positions. Otherwise, while most of the rotors tend to be pivoted from a first position to a second one, one of the rotors may already be in the second position and may stop all rotors from turning. Play between two rotors can be minimized by requiring a slight force to insert a protuberance into a recess.

To assure that switches of a stack are accurately stacked on one another, applicant provides pins 88 (FIG. 3) that extend from the cover of each switch, into corresponding holes 90 in the bottom wall of the adjacent switch. In addition, each shank includes a cylindrical portion 92 (FIG. 6) which is received in a cylindrical hole 82 (FIG. 3) of the cover of the adjacent switch, to further assure that the switches have their axes coincident.

As shown in FIG. 4, the bottom wall 24 of the main housing includes two concentric collars 94, 96 which form an annular groove 98 between them. A corresponding annular collar 100 (FIG. 6) on the rotor is received in that groove to assure that the rotor remains centered on the axis A1. It is noted that a connecting arm 42*b* (FIG. 3) that connects to the second select terminal lies at the bottom of the groove 98 (FIG. 4).

The rotor is provided with a stop 102 (FIG. 4) which lies above the contact pad 60. The stop 102 brings the rotor to an abrupt halt when the stop abuts against one of two abutment faces 104, 106 in the housing.

FIG. 3 shows a bar 108 that includes a main branch 110 that extends parallel to the axis, and ends 111 that are angled from the axis. One of the ends 111 is designed to be received in a notch 114 in the cover of the case of a switch at one end of the stack, while the other end is designed to be received in a notch 112 in the main housing of a switch at the opposite end of the stack. The main body also includes a securing lug 116 with a passage for receiving a screw to mount the switch.

Thus, the invention provides a switch of simple and reliable construction, which minimizes the duration of sparks to increase the switch life, and which facilitates stacking of switches to operate in synchronism. The switch has a rotor body that can pivot on a housing between first and second positions, and a connector mounted on the rotor body. The connector has a contact pad for engaging one of at least a pair of select terminals on the housing, and also has a common contact that is electrically connected to the contact pad for continually engaging a common terminal on the housing. The common terminal is in the form of a track extending in substantially an arc that is centered on the axis of pivoting, with the common contact on the rotor body being engaged with the track as the rotor pivots between the first and second positions. The connector can be formed by a piece of sheet metal mounted on the rotor body, with an arm at one side bent about 90° out of the plane of sheet metal to form the contact pad, and with an arm at the opposite side formed with tabs that ride both above and below the track. The connector is preferably slideable on the rotor body, and a spring biases the connector to urge the contact pad towards the select terminals. A cam mechanism can be used to positively shift the connector radially to move the pad away from a first contact as the pad moves several degrees away from a center position where it is in engagement with the first contact, to reduce the periods of sparks. Each switch and the switch devices that lie with it in a stack, includes a shank extending along the axis, with one end forming a noncircular projection and with the other end forming a recess for receiving a projection.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A switch comprising:

a housing;

a pair of select terminals mounted on said housing at positions angled by a predetermined angle about a pivot axis;

a common terminal mounted on said housing;

a rotor body pivotally mounted on said housing about said pivot axis to pivot between first and second positions;

a connector mounted on said rotor body, said connector having a single contact pad for engaging one of said select terminals at a time as said rotor pivots and also having a common contact that engages said common terminal at both said first and second positions of said rotor;

said common terminal comprising a track extending in substantially an arc of at least said predetermined angle, which is centered on said axis, and said common contact is engaged with said track as said rotor pivots between said first and second positions.

2. The switch described in claim 1 wherein:

said housing has a surface extending in an arc between said pair of select terminals, and with said surface having a plurality of grooves, whereby to minimize the duration of electric arcs.

3. A switch comprising:

a housing;

a pair of fixed select terminals mounted on said housing and a common terminal mounted on said housing;

a rotor pivotally mounted on said housing to pivot about an axis between first and second center positions;

a connector mounted on said rotor to pivot with said rotor, said connector having a contact pad for alternately engaging first and second ones of said select terminals as said rotor pivots between said first and second center positions and said connector having a common contact electrically connected to said contact pad;

said connector being shiftable radially to said axis, and including means for shifting said connector radially to move said pad away from a first of said select contacts as said pad moves angularly away from said first center position in engagement with said first select terminal and for radially shifting said connector to move said pad toward said first select terminal as said pad approaches said first center position.

4. The switch described in claim 3 wherein;

said common terminal comprises an angular track that is curved about said axis;

said common contact includes a wiper with a plurality or resilient tabs lying on axially opposite sides of said track and biased together to press said track between them.

5. A switch comprising:

a housing;

first and second select terminals mounted on said housing and a common terminal mounted on said housing, with said select terminals having faces that face said axis;

a rotor mounted to pivot about an axis in said housing between first and second positions;

a contact arrangement on said rotor for connecting said common terminal to said first or second of said select terminals as said rotor pivots between said first and second positions;

said housing having an innerface that generally faces said axis and that extends in an arc that is centered on said axis, with said inner face having angularly-spaced opposite ends, with said pair of select terminals at said opposite ends of said inner face, and with said inner face having a plurality of axially-extending grooves, whereby to minimize the duration of electric arcs.

6. A switch arrangement, comprising:

a plurality of switches that each includes a housing, a plurality of select terminals mounted on said housing at positions angled about a pivot axis and a common terminal mounted on said housing, a rotor that lies in said housing and that is pivotable about said axis, a contact pad mounted on said rotor and positioned to alternately engage said select terminals as said rotor pivots between first and second positions, and a common contact mounted on said rotor and connected to said contact pad and positioned to engage said common terminal in both said first and second portions of said rotor;

the rotor of each of said switches includes a shank that extends along said axis and that has opposite ends, with one of said shank ends forming a drive protuberance of non-circular cross-section and with the opposite one of said shank ends having a recess of a cross-section complementary to said first end, so a plurality of said switches can be placed in a stack and with the protuberance of the shaft of each of a plurality of said switches received in the recess of the shank of each of a plurality of other ones of said switches, with each protuberance and recess forming engageable keys that assure that the rotors of all switches are all in the same one of said first and second positions at the same time.

7. A switch comprising:

a housing;

a pair of select terminals mounted on said housing at positions angled by a predetermined angle about a pivot axis;

a common terminal mounted on said housing;

a rotor body pivotally mounted on said housing about said pivot axis to pivot between first and second positions;

a connector mounted on said rotor body, said connector having a contact pad for engaging one of said select terminals at a time as said rotor pivots and also having a common contact that engages said common terminal at both said first and second positions of said rotor;

said common terminal comprising a track extending in substantially an arc of at least said predetermined angle, which is centered on said axis, and said common contact is engaged with said track as said rotor pivots between said first and second positions;

said connector is slideable on said rotor body in directions toward and away from said select terminals, and including a spring that urges said connector in a direction to push said contact pad toward a first of said select terminals when said contact pad lies adjacent to said first select terminal.

8. The switch described in claim 7 including:

means for shifting said connector radially to move said pad away from said first select terminal as said pad moves angularly away from a center position in engagement with said first select terminal and for shifting said connector to move said pad toward said first select terminal as said pad approaches said center position.

9. A switch comprising:

housing;

a pair of select terminals mounted on said housing at positions angled by a predetermined angle about a pivot axis;

a common terminal mounted on said housing;

a rotor body pivotally mounted on said housing about said pivot axis to pivot between first and second positions;

a connector mounted on said rotor body, said connector having a contact pad for engaging one of said select terminals at a time as said rotor pivots and also having a common contact that engages said common terminal at both said first and second positions of said rotor;

said common terminal comprising a track extending in substantially an arc of at least said predetermined angle, which is centered on said axis, and said common, contact is engaged with said track as said rotor pivots between said first and second positions;

said common contact has a plurality of resilient tabs lying on opposite sides of said track and biased together to press said track between said resilient tabs.

10. A switch arrangement, comprising:

a plurality of switches that each includes a housing, a pivot axis, a plurality of select terminals mounted on said housing at positions angled about the pivot axis and a common terminal mounted on said housing, a rotor that lies in said housing and that is pivotable about the pivot axis, a contact pad mounted on said rotor and positioned to alternately engage said select terminals as said rotor pivots between first and second positions, and a common contact mounted on said rotor and connected to said contact pad and positioned to engage said common terminal in both said first and second portions of said rotor;

the rotor of each of said switches includes a shank that extends along the axis of the switch and that has opposite ends, with one of said shank ends forming a drive protuberance of non-circular cross-section and with the opposite one of said shank ends having a recess of a cross-section complementary to said first end, so a plurality of said switches can be placed in a stack with the pivot axes of all switches in the stack being coincident and with the protuberance of the shaft of one switch in said stack received in the recess of the shaft of another switch in said stack, with each protuberance and recess forming engageable keys to assure that the rotors of all switches in said stack are all in the same one of said first and second positions at the same time;

the housings of each of said switches includes a plurality of notches, and including a plurality of bars that each extends between opposite ends of said stack of switches, with each bar of said plurality of bars having opposite angled ends that are received in notches of housings of switches in said stack at opposite ends of the stack.

* * * * *

UNITED STATES PATENT AND TRADEMARK OFFICE

CERTIFICATE OF CORRECTION

PATENT NO. : 6,111,208
DATED : August 29, 2000
INVENTOR(S) : Sylvain Rochon; Gerard Bourriaux; Laurent Bouvier; Eric Pinero; Claude Grelier It is certified that error appears in the above-identified patent and that said Letters Patent is hereby corrected as shown below:

On the Title Page,
Item [73] Assignee, change "ITT Manufacturing Enterprises, Inc., Wilmington, Del."to
-- ITT Composants Et Instruments, France; and Schneider Electric S.A., France --

Signed and Sealed this

Twenty-fourth Day of July, 2001

*Attest:*

Nicholas P. Godici

NICHOLAS P. GODICI
*Acting Director of the United States Patent and Trademark Office*

*Attesting Officer*